US006374714B1

(12) United States Patent
Rousseau

(10) Patent No.: US 6,374,714 B1
(45) Date of Patent: Apr. 23, 2002

(54) COMBINED GRADING AND TRIMMING METHOD FOR SAWMILL

(75) Inventor: William A. Rousseau, Bethel, VT (US)

(73) Assignee: Silvatech Corporation, Bethel, VT (US)

( * ) Notice: Subject to any disclaimer, the term of this patent is extended or adjusted under 35 U.S.C. 154(b) by 0 days.

(21) Appl. No.: 09/543,571

(22) Filed: Apr. 5, 2000

Related U.S. Application Data

(63) Continuation-in-part of application No. 09/414,957, filed on Oct. 12, 1999.
(60) Provisional application No. 60/122,092, filed on Feb. 26, 1999.

(51) Int. Cl.[7] ..... B27B 5/04
(52) U.S. Cl. ..... 83/35; 83/13; 83/365; 83/425.3
(58) Field of Search ..... 83/13, 35, 76.8, 83/76.7, 364, 365, 367, 425.2, 425.3, 425.4, 435.2, 437.2

(56) References Cited

U.S. PATENT DOCUMENTS

| | | | | | |
|---|---|---|---|---|---|
| 3,780,777 | A | * | 12/1973 | Davies | 83/365 |
| 3,848,646 | A | * | 11/1974 | Miles | 83/365 |
| 4,023,605 | A | | 5/1977 | Hellstrom et al. | |
| 4,120,333 | A | * | 10/1978 | Hellgren et al. | 83/522 |
| 4,164,248 | A | * | 8/1979 | Rysti | 83/361 |
| 4,413,662 | A | * | 11/1983 | Gregoire et al. | 83/367 |
| 4,484,675 | A | * | 11/1984 | Doherty et al. | 198/413 |
| 4,541,722 | A | * | 9/1985 | Jenks | 83/365 |
| 4,665,786 | A | * | 5/1987 | Shields | 83/364 |
| 4,702,134 | A | | 10/1987 | Corley, III | |
| 4,805,679 | A | * | 2/1989 | Czinner | 144/357 |
| 4,934,229 | A | | 6/1990 | Greten et al. | |
| RE33,357 | E | * | 9/1990 | Randall | 358/106 |
| 4,984,172 | A | * | 1/1991 | Luminari | 364/478 |
| 5,042,341 | A | | 8/1991 | Greten et al. | |
| 5,249,491 | A | * | 10/1993 | Carter | 83/13 |
| 5,254,859 | A | * | 10/1993 | Carman et al. | 83/365 |
| 5,605,216 | A | * | 2/1997 | Raybon et al. | 198/395 |
| 5,862,727 | A | * | 1/1999 | Kelly | 83/13 |
| 5,865,080 | A | * | 2/1999 | Jackson | 83/74 |
| 5,911,302 | A | * | 6/1999 | Jackson | 198/456 |
| 6,199,463 | B1 | * | 3/2001 | Quick | 83/365 |

* cited by examiner

*Primary Examiner*—M. Rachuba
*Assistant Examiner*—Kim Ngoc Tran
(74) *Attorney, Agent, or Firm*—Sughrue Mion, PLLC

(57) ABSTRACT

A method of combining the grading and trimming operation of a board to thereby eliminate the position of a trimmer, includes feeding a board having two sides to a turn assembly with a first side of its two sides upright, grading the first side of the board, moving the board longitudinally using belt, chain, or rollers, and turning the board such that the second side of the board is upright and grading the second side of the board. In one embodiment the board is moved in a longitudinal direction using a roll case, to position the board in a position for trimming; whereas in another embodiment, laser lines projected on the board are moved instead of the board itself. The board is then fed to a trimmer to be cut. A sloped turn assembly or flat transfer assembly can be used to turn the board for inspection.

7 Claims, 8 Drawing Sheets

COMBINED GRADING AND TRIMMING METHOD FOR SAWMILL

CROSS-REFERENCE TO RELATED APPLICATIONS

This application is a continuation-in-part of a U.S. patent application Ser. No. 09/414,957, filed on Oct. 12, 1999, which is incorporated herein by reference in its entirety, and which, under 35 U.S.C. §1.111(a) claims benefit pursuant to 35 U.S.C. §119(e)(1) of the filing date of a Provisional Application No. 60/122,092 filed Feb. 26, 1999, pursuant to 35 U.S.C. §111(b), which is also incorporated herein by reference in its entirety.

BACKGROUND OF THE INVENTION

1. Field of the Invention

The present invention relates to a method of operation of a sawmill or lumber processing facility, wherein the grading and trimming operations are combined, which permits the grader to perform the function of the trimmer operator, thus, eliminating the position of the trimmer operator.

2. Description of the Related Art

In conventional sawmills, a grader works in an area ahead of the trimmer, marking boards for grade and to indicate where on the boards a cutback is required and the ends of the board are to be cut off. A cut back is typically required if a board has excessive wane of defects near the end or ends of the board.

After grading, each board proceeds to the trimmer, and the trimmer operator moves the boards which must be cut back endwise such that the desired cut points are at the saw lines. The trimmer operator also selects the trim saws to be used on the board.

Saws are typically placed at 0 ft., 1 ft., 4 ft., 6 ft., 8 ft., 10 ft., 12 ft., 14 ft., and 16 ft., from an index line. They may extend to 18 ft., 20 ft., etc. A board to be trimmed 12 ft., will be cut by the 0 ft. and 12 ft. saws. A board to be trimmed to 9 ft. will be cut by the 1 ft. and 10 ft. saws.

A drop saw or jump saw trimmer has saws at fixed positions which are lowered (in the case of a drop saw), or raised (in the case of a jump saw), to make the cross cuts to trim the board. A "moving saw" trimmer has a fixed saw at one end and a moving saw which typically strokes from 4 ft. to 16 ft. (from the fixed end).

In any of these three types of trimmer saws, boards which require cut back must be moved endwise (i.e., lengthwise) in relation to the saws to remove the desired amount.

Conventional grading and trimming operations are disclosed by Greten et al, U.S. Pat. No. 4,934,229, Greten et al, U.S. Pat. No. 5,042,341, Hellgren et al, U.S. Pat. No. 4,120,33, Rysti, U.S. Pat. No. 4,164,248, and Hellstrom et al, U.S. Pat. No. 4,023,605.

Doherty et al, U.S. Pat. No. 4,484,675, disclose a conventional board turned apparatus and method, wherein a board can be turned several times for repeated inspection of both sides of the board for more accurate grading.

However, all the above references suffer from the disadvantage that a trimmer operator is required, and since the position of a trimmer operator is difficult to fill due to, at the very least, the repetitive nature of the job, the mechanization of as much as possible of the grading and trimming operations is necessary.

SUMMARY OF THE INVENTION

The object of the present invention is to provide a method of sawmill or lumber processing operation, wherein the grader and trimmer positions are combined, so that the grader performs the function of the trimmer operator, thus, eliminating the position of the trimmer operator.

In a first embodiment of the present invention, the method of grading and trimming a board or other structure having two sides includes feeding the board to a sloped turn assembly with a first side of its two sides upright, grading the first side of the board, and if cutback is desired, moving the board in a longitudinal direction to position the board for trimming, pivoting the board using the sloped turn assembly such that the board falls onto a roll case with a second side of the two sides upright, grading the second side of the board, and if cutback is desired, moving the board in a longitudinal direction to position the board for trimming, feeding the board to a trimmer, and cutting the board.

In a second embodiment of the present invention, the sloped turn assembly is replaced with a flat transfer assembly which can turn the board onto both sides for grading. If a cutback is indicated, the roll case is raised to move the board in a longitudinal direction to a position for trimming.

In a third embodiment of the present invention, instead of moving the board lengthwise at the grading station, lasers which project laser lines across the board at various increments, are moved lengthwise along the board to designate the desired trimmer saw positions by the grader via an instrumented positioning mechanism relative to a known board position established when the board arrives at the grading station. Before the board reaches the trimmer saws, the board passes over a set of rollers which move it endwise against a moveable fence such that the board is positioned relative to the trimmer saws the same as the laser lines were positioned on the board at the grading station.

BRIEF DESCRIPTION OF THE DRAWINGS

Other features and advantages of the invention will be apparent from the following description taken in connection with the accompanying drawings, wherein.

DETAILED DESCRIPTION OF THE PREFERRED EMBODIMENTS

The present invention relates to a method of mechanizing movement of a board endwise at either of two positions in a grading station to position the board properly to be processed by an end trimmer. Thus, the grader performs the function of the trimmer operator, and the position of the trimmer operator is obviated.

Figure 1:
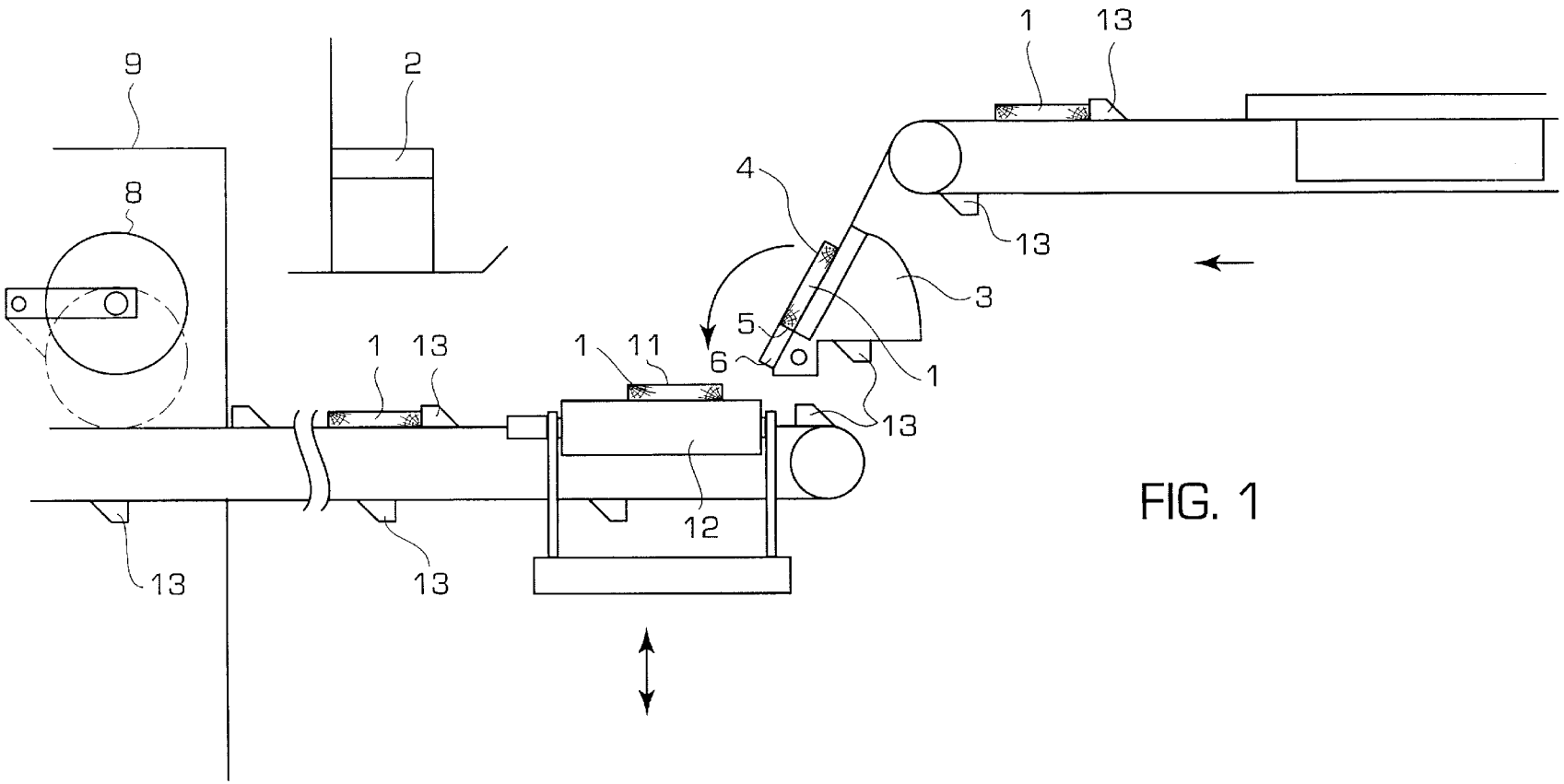
FIG. 1 shows a side view of the grading and trimming operation of a sawmill or lumber processing operation, according to a first embodiment of the present invention.

In the sawmill operation of a first embodiment of the present invention, as shown in FIG. 1, after the boards 1 are measured by conventional means, the boards 1 approach a grading station 2 on a lugged chain and are even ended such that one end of the board 1 extends slightly beyond the 0 ft. saw reference line. The boards 1 are then stopped, and fed one at a time into the grading station 2.

Figure 2:
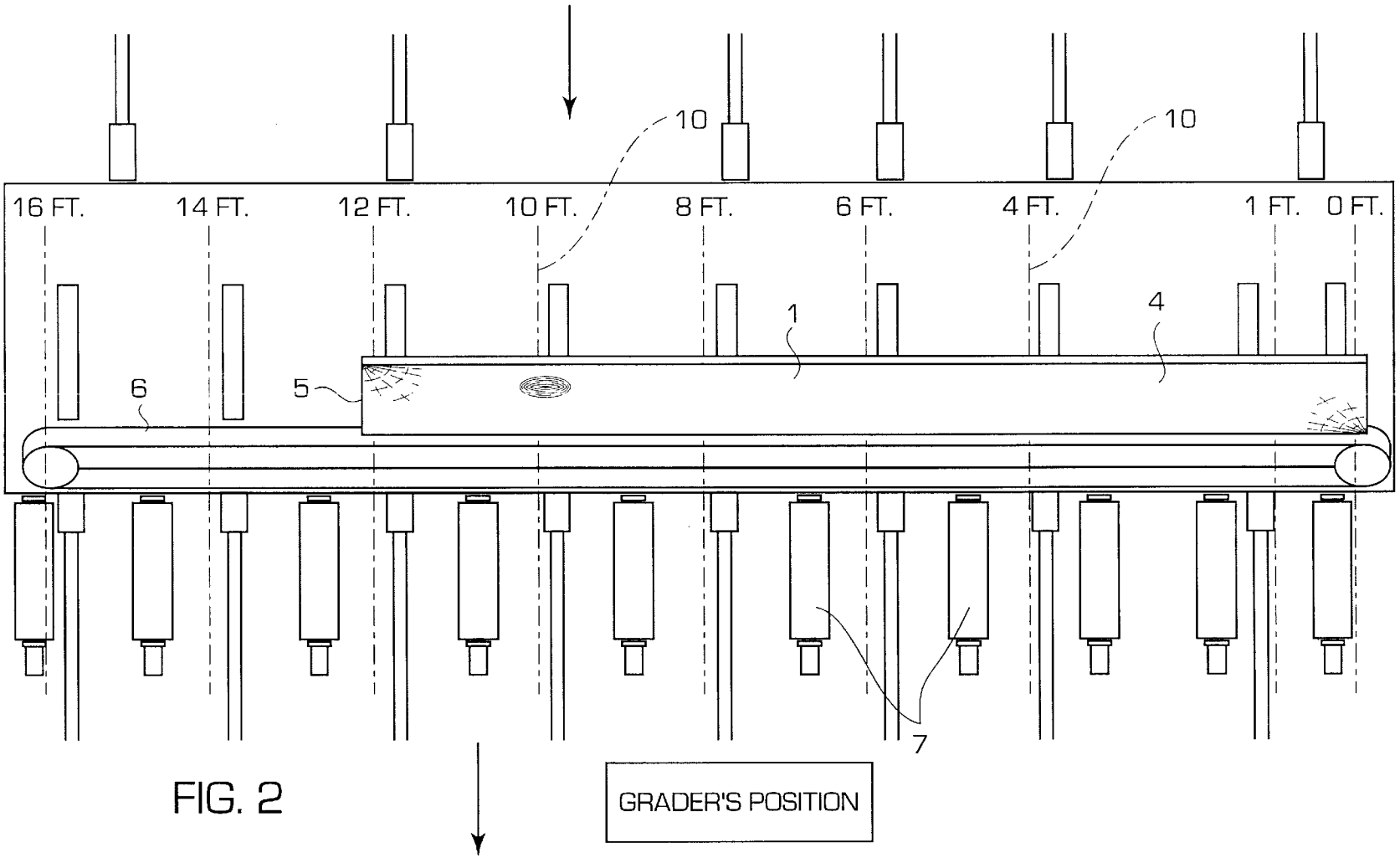
FIG. 2 shows an overhead view of a board on a sloped turn assembly according to a first embodiment of the present invention.

Each board 1 is then fed down at an angle onto a sloped turn assembly 3, as shown in FIG. 2, where a grader working at the grading station 2 views the first face 4 of the board 1 as its edge 5 rests on the conveying belt 6 of the turn assembly 3. (The belt 6 could alternatively be a chain or series of rollers 7 (see FIG. 2)). Either side of the board 1 may exhibit defects which justify cutback.

The position of each saw 8 in the trimmer 9 is displayed as a reference line on the grading station 2, or alternatively, by a projected laser line 10 running across the board 1 at 0 ft., 1 ft., 4 ft., 6 ft., 8 ft., 10 ft., 12 ft., 14 ft., and 16 ft. increments (see FIG. 2), on the turn assembly 3. If the face 4 now viewed has defects requiring cut back, the grader can select the saws 8 to be used by pressing buttons at the grading station 2, and also by moving the board 1 endwise (i.e., longitudinally) by controlling the conveyor belt 6 via foot pedals or hand controls (not shown), to position the board 1 such that the best quality portion of the board 1 falls between the selected saws 8. The buttons (not shown) used to select saws 8 are interfaced to a computer or other controller (not shown) which registers the saw selections for the board 1 for use when the board 1 arrives at the trimmer 9. The computer (not shown) may be part of a tally system which measures the boards 1 for length, width, and thickness, and records a grade inputted by the grader.

Figure 3:
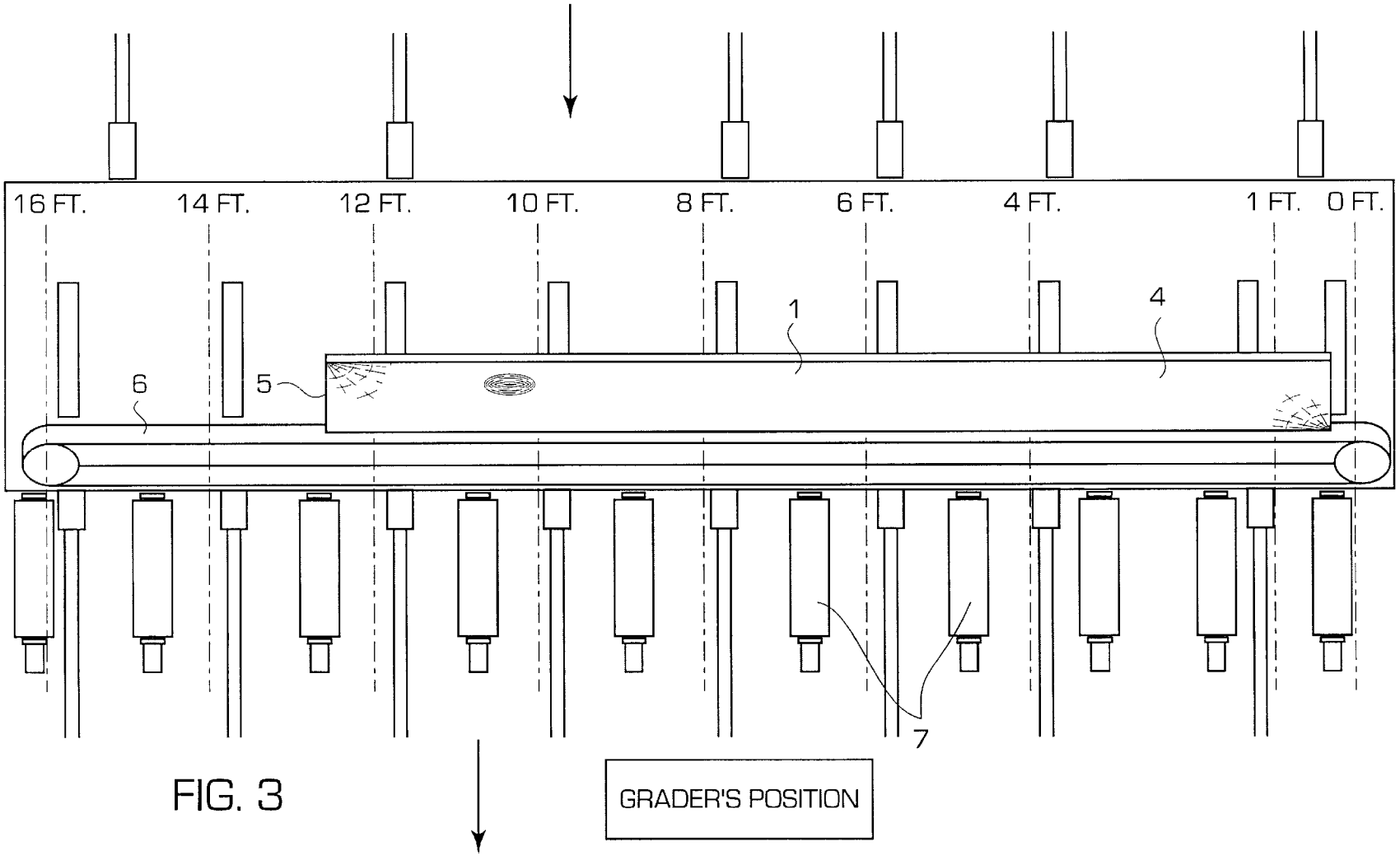
FIG. 3 shows another overhead view of a board on a sloped turn assembly according to a first embodiment of the present invention.

As an example, FIG. 2 shows a 12 ft. board 1 at its initial position in the grading operation on the turn assembly 3. If the grader decides to trim the board 1 back to 9 ft., this will require the 1 ft. and the 10 ft. saws. Therefore, the grader activates the belt 6 in the turn assembly 3 to move the board 1 such that the 1 ft. and 10 ft. saws 8 will now fall in the proper locations on the board 1 to remove the unwanted defects (see FIG. 3).

If the board 1 does not need to be cut back, the computer (not shown) automatically prepares to cut the board 1 to the next even length, in one foot increments.

When ready to view the reverse side 11 of the board 1, the grader presses the turn button or pedal (not shown) which causes the turn assembly 3 to rotate forward endwise and the board 1 to pivot on its longitudinal edge 5, and to fall onto the roll case 12 to display its other side 11. If the view of the reverse side 11 of the board 1 dictates a cut back, the board 1 can be moved endwise (i.e., longitudinally) with respect to the saw reference lines 10.

Displayed across the grading station 2 are either marks or laser light lines (not shown) which indicate the positions of the trimmer saws 8 which await the board 1 further downstream. The grader can thus, see where cross cuts would be made by the various saws 8 in the trimmer 9. The grader may select a trim solution and then shift the board 1 to one side or the other (the board moving lengthwise or longitudinally), by controlling the roll case 12.

When the board 1 is properly positioned on the roll case 12, the grader presses a "release" button (or a grade button if a tally system), such that the board 1 is graded and released to the trimmer 9. At the first opportunity, when a lug 13 is not under the board 1 on the roll case 12, the roll case 12 is lowered (or the chain raised), placing the board 1 in front of a known lug 13. The passing of lugs 13 is monitored by the computer or controller (not shown) and when the lug 13 with this board 1 arrives at the trimmer 9, the computer instructs the trimmer control (not shown) to activate the selected saws 8 (or position the moving saw in that type of trimmer).

Figure 4:
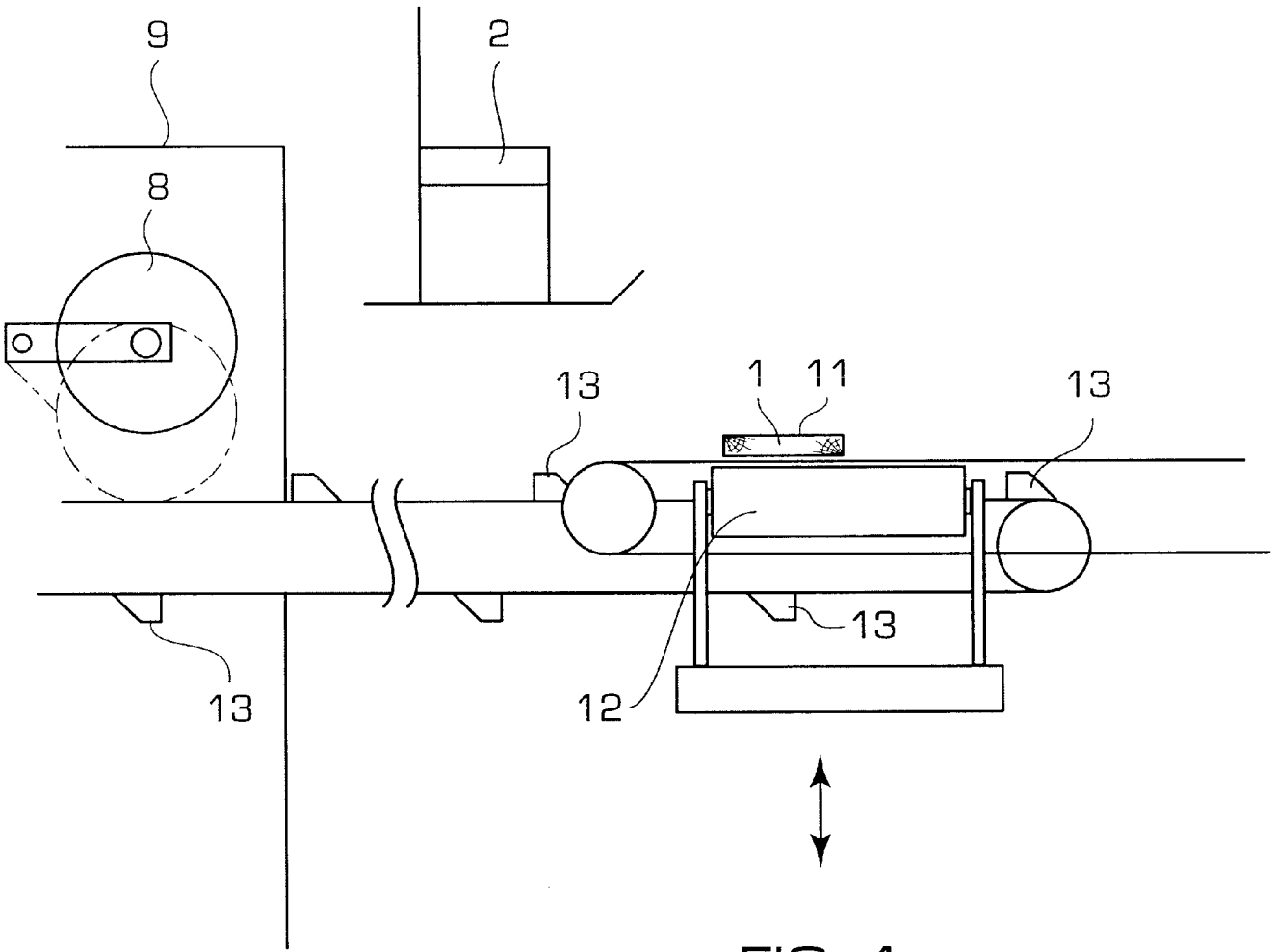
FIG. 4 shows a side view of the grading and trimming operation of a sawmill according to a second embodiment of the present invention.

In a second embodiment of the present invention, a conventional flat grading station 14 can be used instead of a sloping turn assembly 3 grading station, by the grader (see FIG. 4).

In this embodiment, each board 1 is moving along a flat transfer or deck 14 consisting of multiple strands of driven chain. The board 1 arrives at the grading station 2 in the view of the grader, at which position the grader can turn the board 1 to inspect both sides via a conventional board turner apparatus 14, as described for example, in Doherty et al, U.S. Pat. No. 4,484,675. Doherty et al disclose a board turner apparatus and method, wherein a board can be turned several times for repeated inspection of both sides of the board for more accurate grading.

In this embodiment, the board 1 is moved to the grading station 2 by a flat (unlugged) chain deck. The board 1 is turned at the position above the roll case 12. If the board 1 is to be cut back, the roll case 12 is lifted and activated to move the board to the trim position (i.e., longitudinally) by the grader. When the release or grade button is pressed by the grader, either the flat top chain and rollcase 12 are lowered, or the lug chain is raised to load the board 1 onto a predetermined lug for feeding to the trimmer. Alternatively, the board 1 could exit the grading station on the flat chain and proceed to a lug loader station (not shown) in preparation for feeding into the trimmer.

The above side shifting device used to position boards 1 properly for trimming can also be used to move boards 1 lengthwise out of the grading area to either side into a bin or onto another conveyor to be reprocessed or for sorting out culls, etc.

Figure 5:
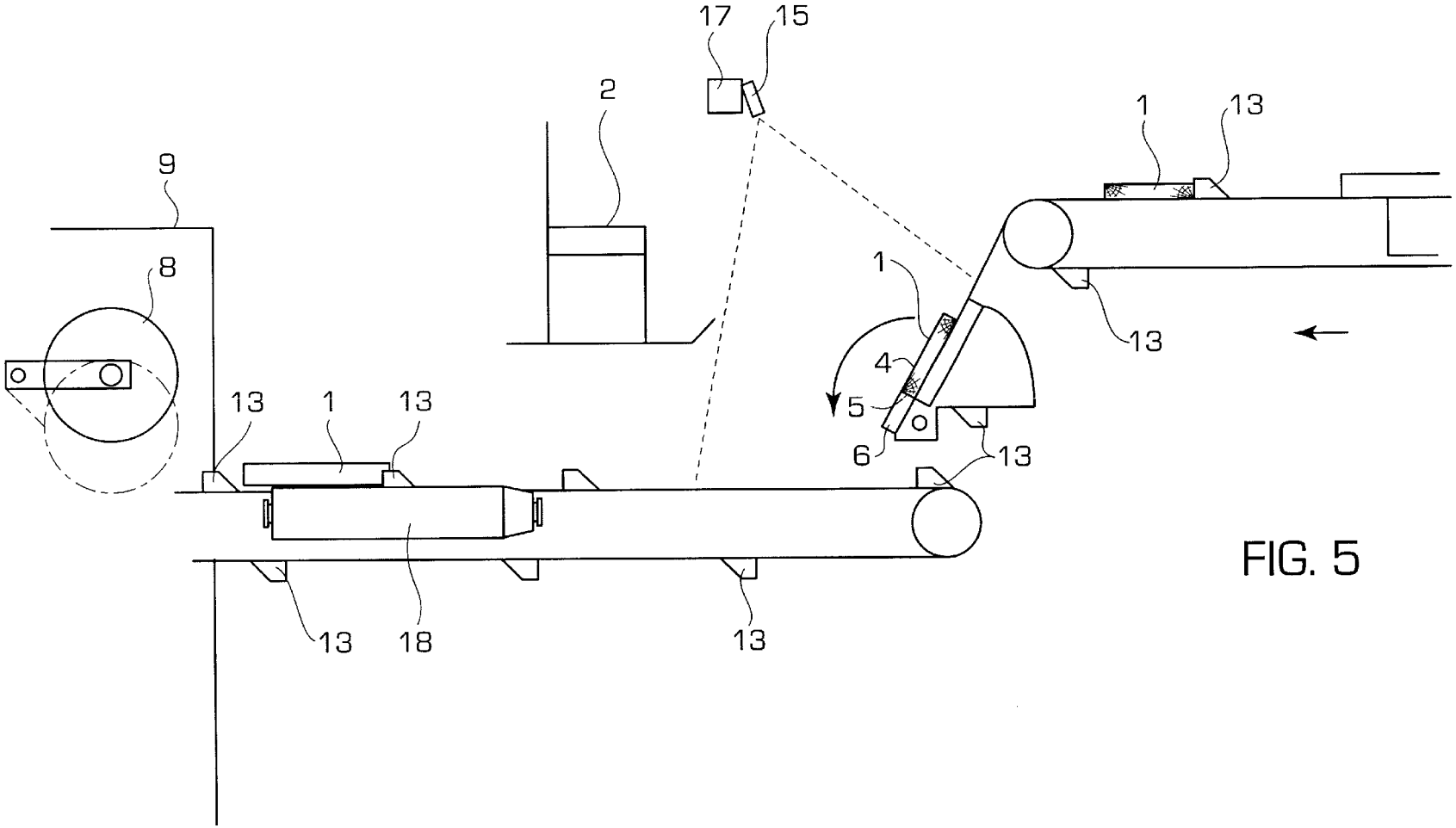
FIG. 5 shows a side view of the grading and trimming operation of a sawmill or lumber processing operation, according to a third embodiment of the present invention.

In a third embodiment of the present invention, instead of moving the board 1 lengthwise at the grading station 2 as in the first embodiment, lasers 15 (see FIG. 5) which project laser lines 10 across the board 1 at increments, are moved by the grader via an instrumented positioning mechanism, to designate the desired trimmer saw 8 positions relative to a known board position established when the board 1 arrives at the grading station 2.

Specifically, lasers 15 are mounted on a laser support beam 17 which can be shifted endwise by any known mechanism (i.e., a cylinder etc.) (see FIG. 5). The laser 15 are typically placed at 0', 1', 4', 6', 8', 10', 12', 14', and 16'. Alternatively to a laser 15 representing each trimmer saw 15, two or more lasers 15 with pivoting mirrors can be used to display the laser lines 10 at the appropriate positions on the board 1.

Figure 6:
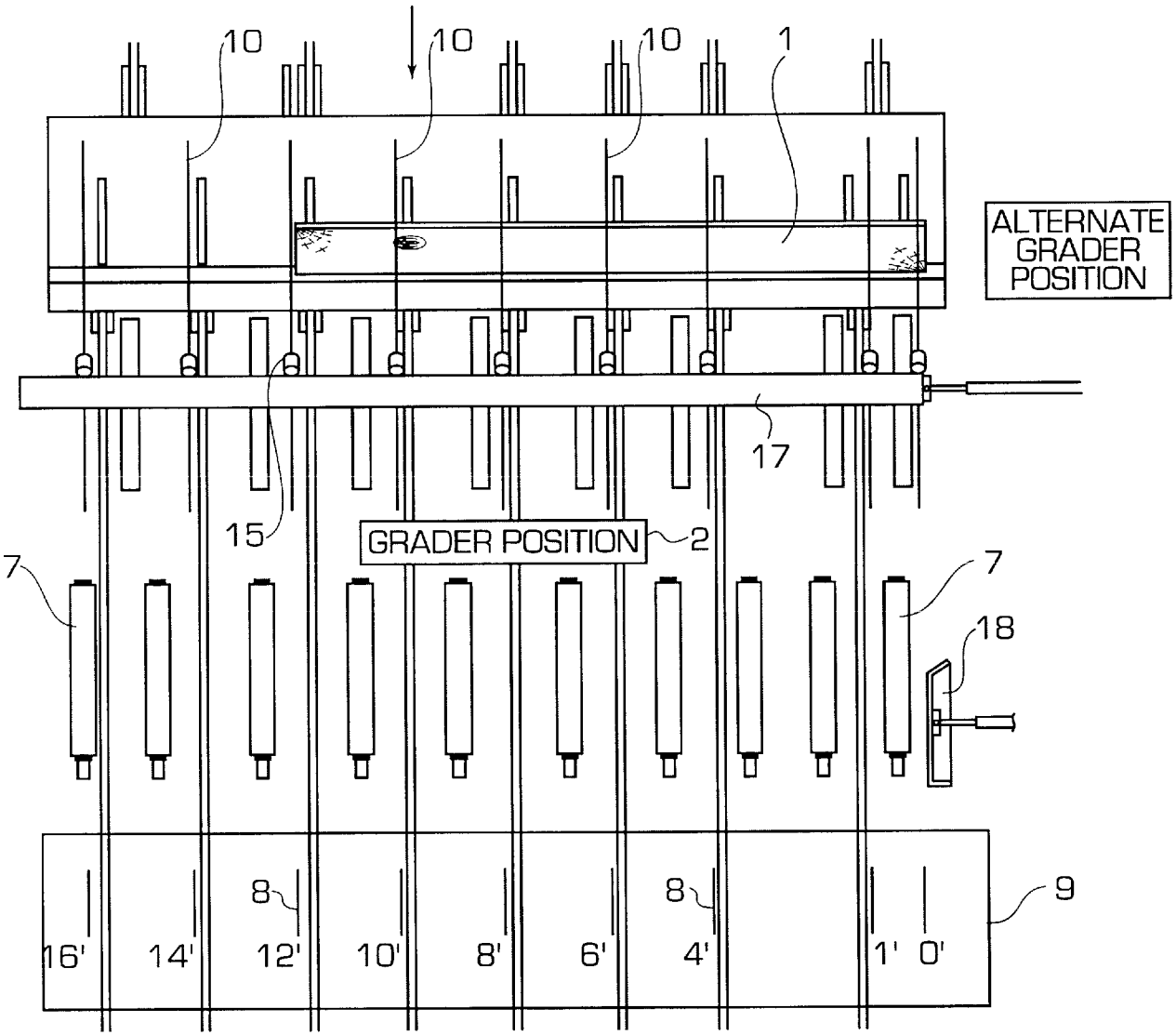
FIG. 6 shows an overhead view of a board on a sloped turn assembly according to a third embodiment of the present invention.

When a new board 1 arrives at the grading station 2, it has been even-ended such that one end is at a known position. The support beam 17 is at a home position such that the laser 15 at the 0' position is just inside the end of the board 1 which is even-ended (see FIG. 6). At this time, all the lasers 15 may be on, or if the length of the board 1 has already been measured, only the lasers 15 indicating the measured length may be turned on.

If the grader decides that the board 1 should have the wane and knot removed, the grader can choose a desired length (i.e., a 9' length) or designate the trimmer saws 8 to be used (i.e., the 1' and 10' trimmer saws 8), while the board is in the grading station 2, by pressing the appropriate buttons, and the trim solution is recorded by the computer or controller (not shown).

Specifically, the actual desired position of the designated trimmer saws 8 is indicated on the board 1 by the grader moving the laser support beam 17 via a conventional mechanism (i.e., foot pedals, joy stick, buttons, etc.) to the right of his position (in this case, approximately 6 inches), and the movement of the support beam 17 is instrumented and the final position of the support beam 17 is recorded by the computer or controller. The computer or controller may now leave all the lasers 15 turned on, or can turn off all but the 1' and 10' lasers 15 (the choice being selected by the grader).

The grader will now flip the board 1 down using the turn assembly 3. If the board 1 requires cut back and the trim solution was not entered for the first viewed side of the board, it would be entered for the reverse side 11 of the board 1.

Figure 7:
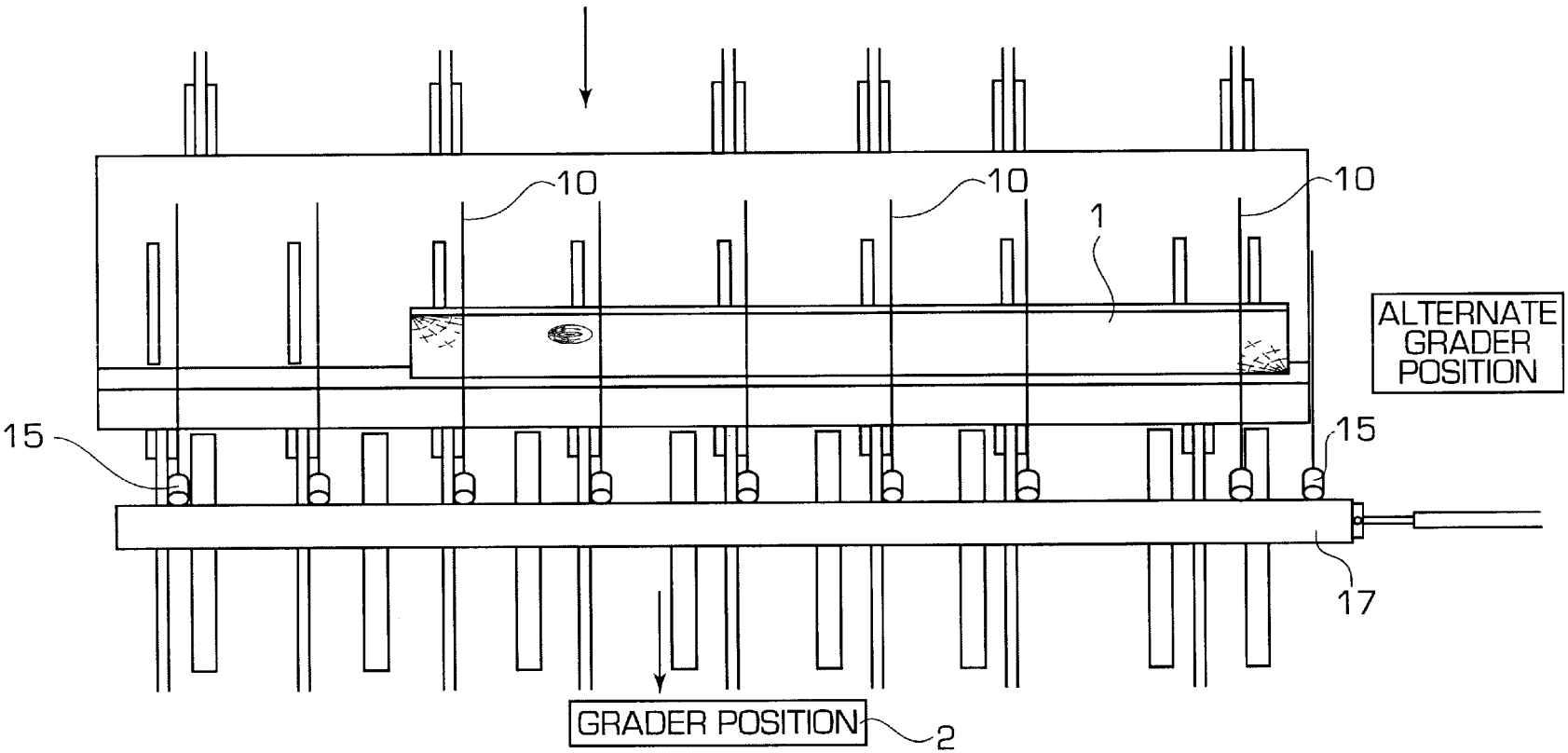
FIG. 7 shows an overhead view of a board on a sloped turn assembly according to a third embodiment of the present invention (fence in home position).

The board 1 then proceeds towards the trimmer 9. Before the board 1 reaches the trimmer saws 8, the board 1 passes over a set of rollers 7 which move it endwise against a moveable fence 18 positioned by the computer or controller such that the board 1 is positioned relative to the trimmer saws 8 in accordance with the way the laser lines 10 were positioned on the board 1 at the grading station 2 (see FIG. 7). The combination of the rollers 7 and fence 18 can move the board endwise in either direction relative to the trimmer saws 8.

For example, with a board 1 which must be moved to the left, the rollers 7 can move the board 1 to the left before it reaches the moveable fence 18, then move it back to the right against the fence 18. Alternatively, the fence 18 can move to the right away from the board 1, and when the board 1 arrives, push the board 1 to the left. Further, since the movement of the support beam 17 is instrumented by the controller or computer, the controller or computer calculates the trim solution such that the rollers 7 and the moveable fence 18 at the trimmer 9 must move the board 1 the same 6 inches to the grader's left, and use the 1' and 10' trimmer saws 8 to trim the board 1. Thus, when the board 1 reaches the rollers 7 and the moveable fence 18, the board 1 will be correctly positioned.

Alternatively, other mechanical means, such as instrumented rollers with one or more top press rollers etc., may be used to shift the board relative to the trimmer saws 8.

Figure 8:
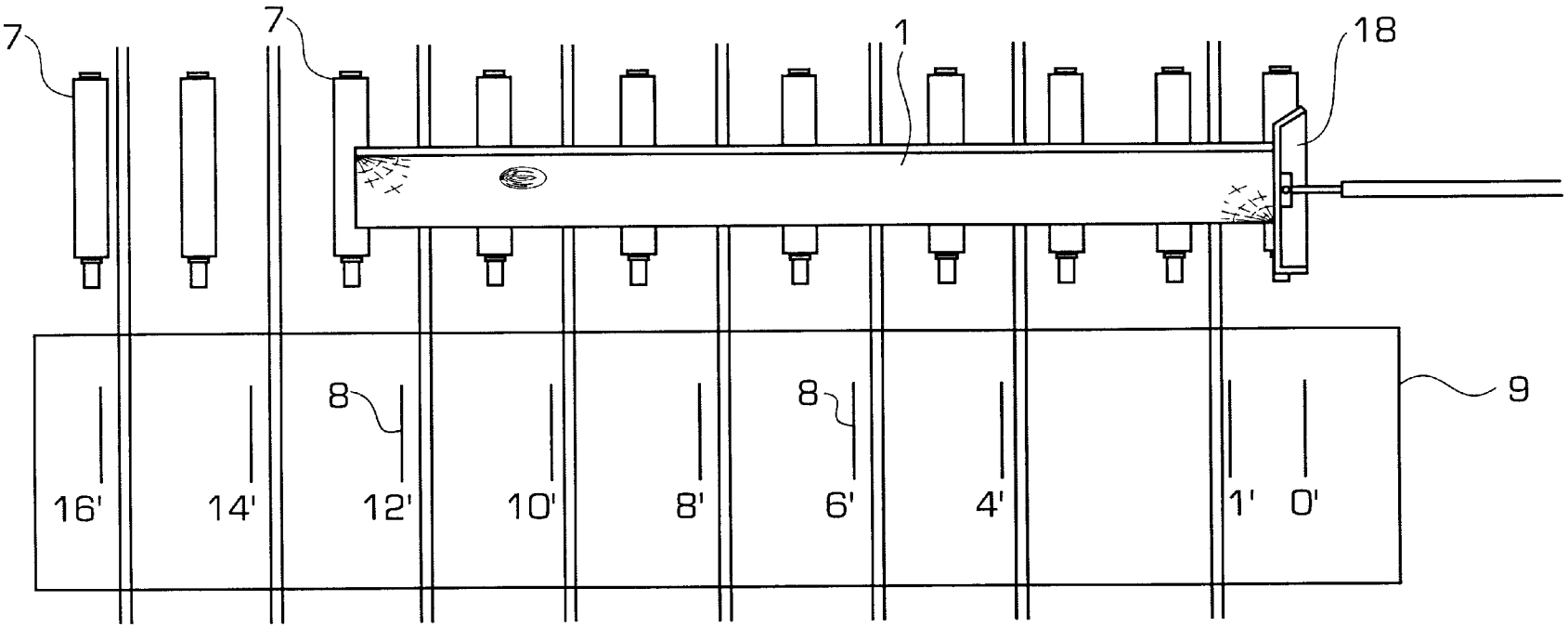
FIG. 8 shows an overhead view of a board on a sloped turn assembly according to a third embodiment of the present invention (fence in cutback position).

However, if the board 1 does not need to be cut back, the laser support beam 17 is not moved, and when the board 1 proceeds to the trimmer 9, the board 1 will not be moved in relation to the trimmer saws 8, and the 0' and 12' trimmer saws 8 will be used to trim the board 1. The board 1 will not be moved endwise by the rollers 7 or moveable fence 18 before entering the trimmer 9 (see FIG. 8).

The third embodiment permits the inclusion of two or more (typically flat) grading stations 2 with the control system (i.e., computer or controller) keeping track of the boards 1 by lug on the lugged chain. The grader at each grading station 2 has a set of indicator lasers 15 and the control system records the trim solution including the position of the lasers 15 and laser lines 10 for use when the board 1 reaches the trimmer 9.

Thus, the present invention automates the trimming operation by combining the grading and trimming functions, thus providing for the elimination of a trimmer operator.

The present invention can be used in other inspection and cutting operations other than for boards in a sawmill.

It is contemplated that numerous modifications may be made to the apparatus and procedure of the invention without departing from the spirit and scope of the invention as defined in the following claims.

What is claimed is:

1. A method of grading and cutting a board, the method comprising the steps of:

(1) feeding the board to a grading station;

(2) initially projecting laser lines across the board in the grading station to indicate fixed cutting positions, respectively, pairs of the laser lines corresponding to trim settings for cutting off both ends of the board;

(3) identifying a first trim setting as the pair of laser lines which are spaced furthest apart and which extend across the board;

(4) inspecting a first face of the board for defects, and if unwanted defects are present on the first face which are positioned between the laser lines corresponding to the first trim setting, then (a) identifying a second trim setting that is shorter than the first trim setting, and (b) moving the laser lines relative to the board so that the unwanted defects on the first face are not positioned between the pair of laser lines corresponding to the second trim setting;

(5) inspecting a second face of the board for defects, and if unwanted defects are present on the second face which are positioned between the laser lines corresponding to one of the first trim setting and the second trim setting, then (a) identifying a third trim setting that is shorter than one of the first trim setting and the second trim setting, and (b) moving the laser lines relative to the board so that the unwanted defects on the second face are not positioned between the pair of laser lines corresponding to the third trim setting;

(6) positioning the board relative to the fixed cutting positions based on the shortest identified one of the first, the second, and the third trim settings; and (7) cutting off both ends of the board.

2. The method according to claim 1, wherein moving the laser lines includes moving the laser lines in the same direction relative to the board.

3. The method according to claim 1, further comprising the step of:

turning the board over after inspecting the first face and before inspecting the second face.

4. The method according to claim 1, wherein the step (6) includes moving the board in a longitudinal direction of the board.

5. The method according to claim 1, further comprising the step of:

measuring the length of the board; and identifying the first trim setting based on the measured length of the board.

6. The method according to claim 1, wherein the laser lines are projected continuously from steps (2)–(5).

7. The method according to claim 1, wherein both ends of the board are cut at the same time.

* * * * *